US009837046B2

(12) United States Patent
Kudo et al.

(10) Patent No.: US 9,837,046 B2
(45) Date of Patent: Dec. 5, 2017

(54) DISPLAY CONTROL DEVICE AND CONTROL METHOD THEREFOR

(71) Applicant: CANON KABUSHIKI KAISHA, Tokyo (JP)

(72) Inventors: Seiji Kudo, Zushi (JP); Tomoyuki Ohno, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 14/601,069

(22) Filed: Jan. 20, 2015

(65) Prior Publication Data

US 2015/0206505 A1 Jul. 23, 2015

(30) Foreign Application Priority Data

Jan. 23, 2014 (JP) ..... 2014-010182

(51) Int. Cl.
*G09G 5/02* (2006.01)
*G09G 3/00* (2006.01)

(52) U.S. Cl.
CPC ..... *G09G 5/026* (2013.01); *G09G 3/006* (2013.01); *G09G 2320/0666* (2013.01); *G09G 2320/0693* (2013.01); *G09G 2340/06* (2013.01); *G09G 2360/145* (2013.01)

(58) Field of Classification Search
CPC ..... G09G 5/02; G09G 2320/0666; G09G 2360/145; G09G 2320/0693
USPC ..... 345/591, 690
See application file for complete search history.

(56) References Cited

U.S. PATENT DOCUMENTS 6,522,313 B1 * 2/2003 Cottone ..... G09G 5/003 345/22
6,630,938 B1 * 10/2003 Nanni ..... G09G 5/003 345/629
7,102,648 B1 * 9/2006 Holub ..... G06F 3/14 345/589

(Continued)

FOREIGN PATENT DOCUMENTS

JP 2009-060221 A 3/2009
JP 2013-219557 A 10/2013
WO 01/015129 A1 3/2001

OTHER PUBLICATIONS

The above foreign documents cited were cited in the Sep. 26, 2017 Japanese Office Action, a copy of which is without an English Translation, that issued in Japanese Patent Application No. JP2014-010182.

*Primary Examiner* — Jose Soto Lopez
(74) *Attorney, Agent, or Firm* — Cowan, Liebowitz & Latman, P.C.

(57) ABSTRACT

A display control device comprises calibration unit configured to display an image for colorimetry on a screen of a display panel and performing calibration processing of adjusting display quality of the display panel on the basis of a colorimetry result obtained by colorimetry with a sensor; detection unit configured to detect a predetermined event that can decrease an accuracy of colorimetry of the sensor while the calibration processing is executed; and determination unit configured to perform determination processing of determining whether or not to stop the calibration processing by comparing the colorimetry results before the detection and after the detection of the predetermined event with the sensor when the detection unit has detected the predetermined event.

20 Claims, 10 Drawing Sheets

(56) References Cited

U.S. PATENT DOCUMENTS 7,626,728 B2 * 12/2009 Itagaki ..... G03G 15/01 356/406
2004/0165024 A1 * 8/2004 Vilanova ..... H04N 1/6033 347/19
2004/0196250 A1 * 10/2004 Mehrotra ..... G09G 5/02 345/102
2005/0275912 A1 * 12/2005 Chen ..... G09G 5/02 358/523
2006/0058619 A1 * 3/2006 DeYoe ..... G09B 23/28 600/407
2006/0066882 A1 * 3/2006 Yamauchi ..... H04N 1/6033 358/1.9
2007/0071343 A1 * 3/2007 Zipnick ..... G06T 5/50 382/254
2008/0252653 A1 * 10/2008 Alessi ..... G09G 3/3208 345/589
2010/0020107 A1 * 1/2010 Chui ..... G09G 3/005 345/690
2010/0157159 A1 * 6/2010 Kim ..... G09G 3/3648 348/607
2010/0188418 A1 * 7/2010 Sakai ..... G01J 1/4204 345/594
2010/0253613 A1 * 10/2010 Dunn ..... G09G 3/3413 345/102
2011/0001728 A1 * 1/2011 Hosorogi ..... G09G 5/08 345/175
2011/0169414 A1 * 7/2011 Schmitz ..... G09G 3/3413 315/153
2012/0086344 A1 * 4/2012 Schuch ..... G02F 1/133603 315/152
2012/0127324 A1 * 5/2012 Dickins ..... G09G 3/006 348/191
2013/0016081 A1 * 1/2013 Park ..... G09G 3/006 345/207
2013/0016119 A1 * 1/2013 Ukawa ..... G09G 5/005 345/589
2013/0050784 A1 * 2/2013 Yamamoto ..... H04N 1/6033 358/505
2013/0147860 A1 * 6/2013 Ishida ..... G09G 5/10 345/690
2013/0201224 A1 * 8/2013 Kang ..... H04N 9/73 345/690
2013/0329057 A1 * 12/2013 Al-Dahle ..... H04N 17/00 348/189
2014/0104658 A1 * 4/2014 Ishizuka ..... G03G 15/5058 358/3.24
2014/0192209 A1 * 7/2014 Yin ..... G09G 3/006 348/191
2015/0070402 A1 * 3/2015 Shah ..... G09G 3/2003 345/690
2015/0138257 A1 * 5/2015 Imai ..... G09G 3/3208 345/691
2015/0302824 A1 * 10/2015 Matsushita ..... G09G 5/02 345/690

* cited by examiner

DISPLAY CONTROL DEVICE AND CONTROL METHOD THEREFOR

BACKGROUND OF THE INVENTION

Field of the Invention

The present invention relates to a display control device and a control method therefor.

Description of the Related Art

Displays for business, or the like, are calibrated in order to reduce changes in display quality with the passage of time. In the calibration (CAL), a white or gray image (referred to hereinbelow as "patch image") is displayed on a display screen, and the brightness and chromaticity of the patch image are repeatedly measured using a colorimeter (CAL sensor).

In the calibration, the display quality (display characteristic) is adjusted such that the brightness and chromaticity are brought close to the desired values on the basis of colorimetry results obtained for a plurality of patch images.

FIG. 2 shows an example of display and colorimetry sequence for patch images in the calibration. In FIG. 2, the transverse direction represents the passage of time. In the example depicted in FIG. 2, patch images are repeatedly displayed in the order of (n−1)-th patch image, n-th patch image, and (n+1)-th patch image and colorimetry is performed. The colorimetry is performed within a period of time in which the patch images are displayed. Since the display quality is adjusted such that the brightness and chromaticity are brought close to the desired values on the basis of colorimetry results, a long time is required to execute the calibration. For example, about 10 min are needed for one calibration cycle.

Further, in order to improve the calibration accuracy, it is important to measure accurately the brightness and chromaticity of the display screen with a colorimeter. In order to increase the accuracy of colorimetry, it is important not only to improve the performance of the colorimeter itself in terms of the accuracy of colorimetry, but also to arrange the display and colorimeter at correct positions. Where the colorimeter is not arranged at a correct position with respect to the display screen, the accuracy of colorimetry is sometimes degraded and the target display quality cannot be reached.

Where buttons on the display body are operated or an image cable is inserted or removed during the calibration, the arrangement position of the colorimeter relative to the display screen can change significantly. In such a case, the colorimetry of the patch images cannot be normally performed because the accuracy of colorimetry is degraded by such significant change in the arrangement position. Where the calibration is continued in a state in which the colorimetry cannot be normally performed, the colorimetry results become abnormal and the calibration can eventually fail. Thus, since the calibration fails when it is continued in a state with the decreased accuracy of colorimetry, the user wastes time.

Japanese Patent Application Publication No. 2009-60221 relates to determining whether or not a color chart, which is outputted when data are created for printer calibration, is arranged correctly in a colorimeter. The determination is made for each color chart on the basis of a determination rule, which is created on the basis of output indication values of a specific patch in the color chart, and the actual colorimetry results for the color chart.

In display calibration, the calibration can fail when the colorimetry fails even for one patch image. The failure of calibration, as referred to herein, is for example, the case in which the display is not adjusted to the desired display characteristic. Therefore, the colorimetry needs to be accurately performed for all of the patch images. In order to perform the colorimetry accurately for a patch image, it is necessary that the accuracy of colorimetry performed by the colorimeter itself be good and that the colorimeter be correctly arranged with respect to the display. The calibration can fail even when the colorimeter arrangement position is slightly changed. Accordingly, determining whether or not the colorimeter (CAL sensor) is correctly arranged with respect to the display for each cycle of patch image colorimetry can be considered as a measure for preventing the calibration failure.

However, where the determination as to whether or not the colorimeter is correctly arranged with respect to the display is performed for each cycle of patch image colorimetry, the number of determination processing cycles increases and the calibration execution time is extended. For example, the calibration that has been conventionally completed in 10 min requires 15 min.

Meanwhile, where the calibration is performed without determining whether or not the colorimeter is correctly arranged with respect to the display, the calibration is completed in 10 min, but where the calibration fails, the 10 min are wasted.

SUMMARY OF THE INVENTION

It is an objective of the present invention to suppress the extension of the execution time of display calibration while preventing the display calibration from failure.

A first aspect of the present invention resides in a display control device comprises: a calibration unit configured to display an image for colorimetry on a screen of a display panel and to perform calibration processing of adjusting display quality of the display panel on the basis of a colorimetry result obtained by colorimetry with a sensor; a detection unit configured to detect a predetermined event that can decrease an accuracy of colorimetry of the sensor while the calibration processing is executed; and a determination unit configured to perform determination processing of determining whether or not to stop the calibration processing by comparing the colorimetry results before and after the detection of the predetermined event with the sensor when the detection unit has detected the predetermined event.

A second aspect of the present invention resides in a control method for a display control device, the method comprises: displaying an image for colorimetry on a screen of a display panel and performing calibration processing of adjusting display quality of the display panel on the basis of a colorimetry result obtained by colorimetry with a sensor; detecting a predetermined event that can decrease an accuracy of colorimetry of the sensor while the calibration processing is executed; and performing determination processing of determining whether or not to stop the calibration processing by comparing the colorimetry results before and after the detection of the predetermined event with the sensor when the detection unit has detected the predetermined event.

In accordance with the present invention, the extension of the execution time of display calibration can be suppressed while preventing the display calibration from failure.

Further features of the present invention will become apparent from the following description of exemplary embodiments with reference to the attached drawings.

DESCRIPTION OF THE EMBODIMENTS

Embodiments of the display control device and control method thereof in accordance with the present invention are described hereinbelow.

Embodiment 1

Embodiment 1 is explained hereinbelow with reference to the drawings.

Embodiment 1 represents an example in which whether or not the calibration is to be continued is determined on the basis of detection of a main body button operation (button operation) which is an event that can decrease the accuracy of colorimetry as the colorimetry of calibration is executed.

Configuration Example

Figure 1:
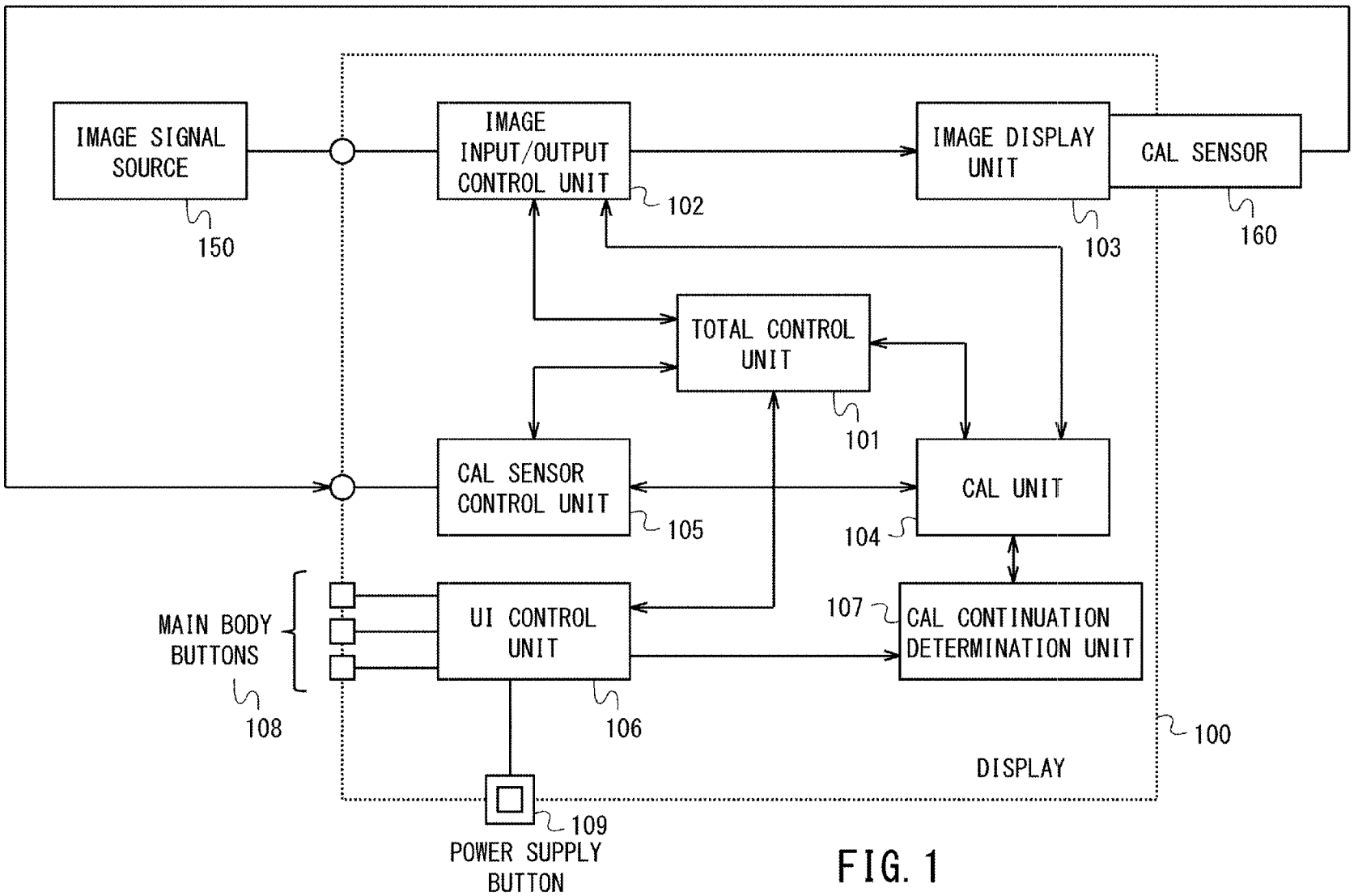
FIG. 1 is a block diagram illustrating the principal configuration of the display control device of Embodiment 1 and Embodiment 2.

FIG. 1 is a block diagram illustrating the principal configuration of the display in Embodiment 1.

A display 100 depicted in FIG. 1 has an image display unit 103 which is a display panel, and a display control device that controls the image display unit 103. The display control device has a total control unit 101, an image input/output control unit 102, a CAL unit 104, a CAL sensor control unit 105, a UI control unit 106, a CAL continuation determination unit 107, main body buttons 108, and a power supply button 109. An image signal is inputted to the display 100 from an image signal source 150. The image signal is a signal for displaying an image on an image display unit 103 of the display 100. An external CAL sensor 160 is connected to the display 100.

The total control unit 101 controls the entire display 100.

The image input/output control unit 102 subjects the image signal inputted from the image signal source 150 to predetermined processing and outputs the processed signal to the image display unit 103. The image input/output control unit 102 subjects the image signal of a patch image inputted from the CAL unit 104 to predetermined processing and outputs the processed signal to the image display unit 103. The image input/output control unit 102 performs the display control of the image display unit 103. The image input/output control unit 102 also may generate the image signal of a patch image in response to a patch image display request from the CAL unit 104 and output the generated signal to the image display unit 103.

The image display unit 103 displays on a screen the image of the image signal inputted from the image input/output control unit 102. The image display unit 103 is, for example, a display panel such as a liquid crystal display panel, a plasma display panel, and an organic electro-luminescence (EL) display panel. A portion including a display panel can be also referred to as a display device (display device body).

The CAL unit 104 controls the calibration of the display characteristic of the image display unit 103. The CAL unit 104 outputs the image signal of the patch image to be used in calibration to the image input/output control unit 102. The CAL unit 104 also issues a patch image display request to the image input/output control unit 102. The CAL unit 104 displays the patch image on the image display unit 103 through the image input/output control unit 102. The CAL unit 104 adjusts the display quality of the image display unit 103 on the basis of a colorimetry result.

The CAL sensor control unit 105 controls the CAL sensor 160. The CAL sensor control unit 105 acquires a colorimetric value measured by the CAL sensor and outputs the acquired value to the CAL unit 104.

The UI control unit 106 controls the main body buttons 108 and the power supply button 109. Where it is detected that the main body button 108 or the power supply button 109 has been operated, the UI control unit 106 notifies the total control unit 101 or the CAL continuation determination unit 107 of the operation detection. The user of the display 100 can display the menu of on-screen-display (OSD) functions and select the menu and can control the settings of the display 100 by operating the main body buttons 108. The user of the display 100 can adjust the settings such as signal input settings and brightness and contrast of the displayed image and perform the calibration by operating the main body buttons 108.

The CAL continuation determination unit 107 determines whether or not an event (predetermined event) that can decrease the accuracy of colorimetry has been detected. Thus, the CAL continuation determination unit 107 performs the event detection for detecting the predetermined event. The CAL continuation determination unit 107 also determines whether to not to continue the calibration (calibration processing). Thus, the CAL continuation determination unit 107 performs the calibration stop determination (stop determination processing).

The main body buttons 108 are the operation buttons of the display 100. The user of the display 100 can, for example, select the menu of the OSD function by operating the main body buttons 108.

The power supply button 109 controls the power supply of the display 100. The power supply button 109 is deactivated as the calibration is executed. Thus, even when the user of the display 100 pushes the power supply button 109 as the calibration is executed, the power supply is not switched off and the calibration is continued.

The image signal source 150 outputs the image signal of the image to be displayed on the display 100 to the display 100. A personal computer (PC) is an example of the image signal source 150.

The CAL sensor 160 performs the colorimetry of the image, which is to be displayed on the screen of the image display unit 103, on the basis of the indication from the CAL sensor control unit 105. The result of colorimetry performed by the CAL sensor 160 is acquired by the CAL sensor control unit 105.

Operation Example

The operation of determining whether or not to continue the calibration is explained below on the basis of the event that can decrease the accuracy of colorimetry.

Figure 2:
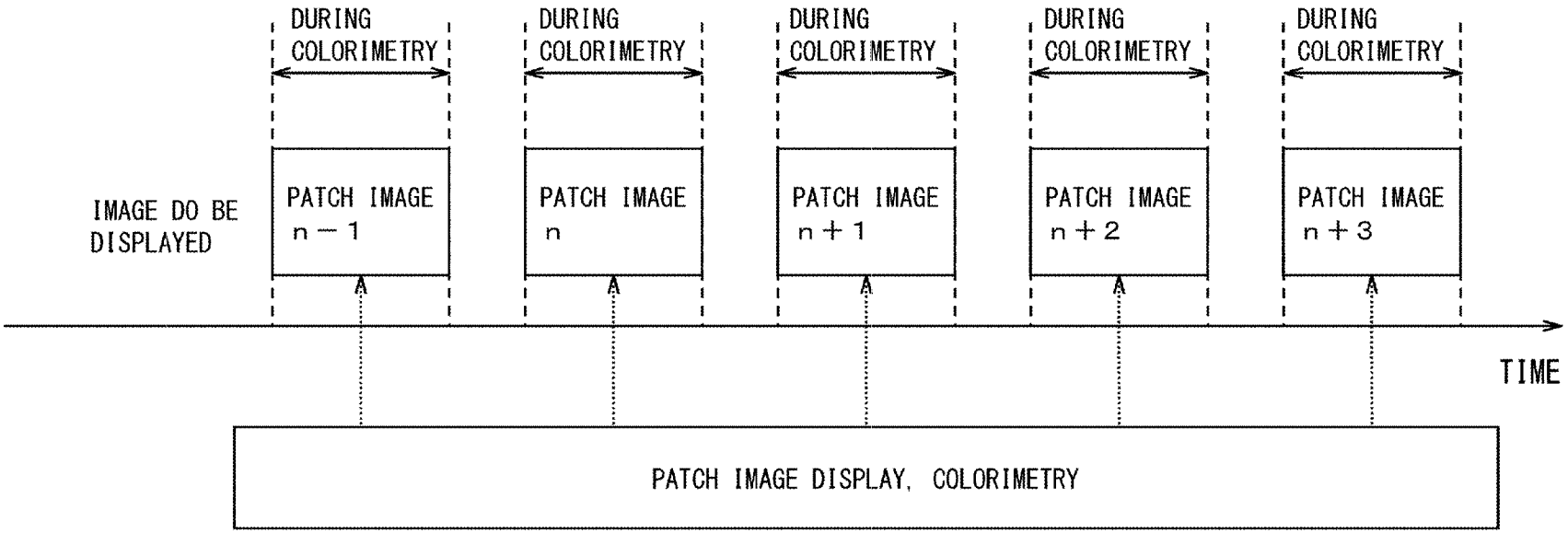
FIG. 2 is an example of patch display and colorimetry sequence in calibration.

The calibration of the display characteristic of the image display unit 103 is started by the user's operation. The display 100 is calibrated using a plurality of patch images of different brightness and color. The patch images serve for colorimetry and are, for example, rectangular monochromatic images of predetermined brightness and color. The patch image is an example of an image for colorimetry. During the calibration, the display 100 displays the patch images on the image display unit 103. The display 100 also performs colorimetry of the patch images displayed on the image display unit 103 with the CAL sensor 160 and hides the patch images displayed on the image display unit 103. Where an event that can decrease the accuracy of colorimetry (can be also referred to as a predetermined event) is not detected as the colorimetry is performed (during the colorimetry), the patch images are displayed as shown in FIG. 2. The display 100 repeats such operations with respect to a plurality of patch images as the calibration is executed. The period of time in which the colorimetry of the patch image is performed is within the period of time in which the patch image is displayed. The colorimetry values (for example, brightness and chromaticity) for each patch image which are measured with the CAL sensor 160 are acquired by the CAL sensor control unit 105. The calibration in the display 100 is controlled by the CAL unit 104.

In the calibration (calibration processing), a plurality of patch images that differs in brightness or color is sequentially displayed one by one on the screen. The CAL sensor control unit 105 issues a patch image colorimetry request to the CAL sensor 160, acquires the colorimetry result, and transmits the acquired result to the CAL unit 104. The CAL sensor 160 performs the colorimetry of the patch images displayed on the screen for each patch image (each image for colorimetry). The colorimetry result for each patch image is stored, for example, in the CAL unit 104. The display quality is adjusted on the basis of the colorimetry result acquired by the CAL unit 104 so as to bring the brightness and chromaticity to the desired values. Thus, where the colorimetry result relating to a patch image is obtained, the CAL unit 104 determines a CAL value for obtaining the desired display characteristic (display quality) and sets this value in the image input/output control unit 102. The CAL value is, for example, an adjustment value for adjusting the RGB values and balance. Where the colorimetry of the patch images is not performed correctly, the CAL value for obtaining the desired display characteristic is not calculated correctly. Therefore, the colorimetry should be correctly performed with respect to all of the patch images.

Figure 3:
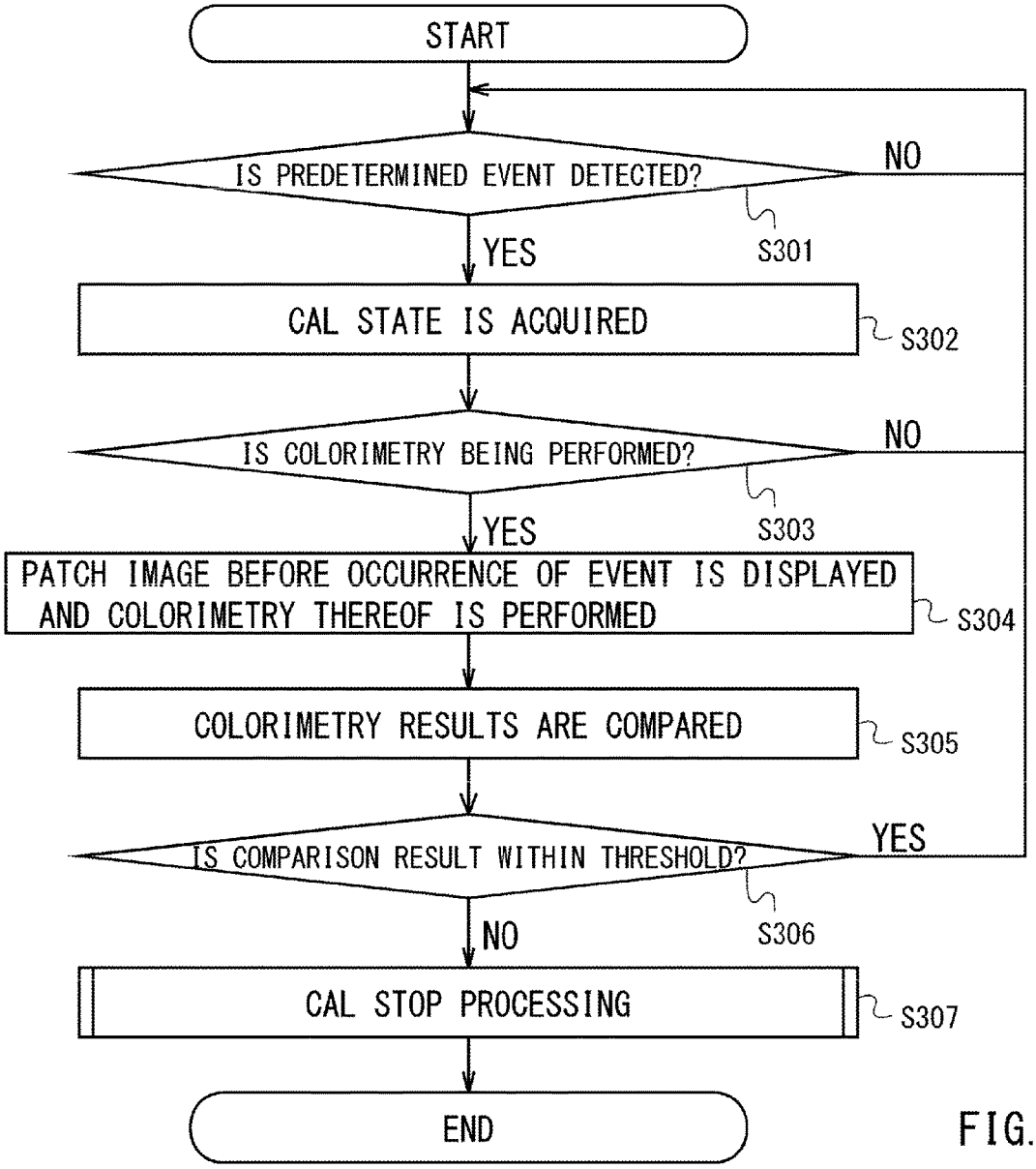
FIG. 3 is an example of operation flow relating to Embodiment 1.

FIG. 3 depicts the operation flow for determining whether or not the calibration can be continued when an event that can decrease the accuracy of colorimetry has been detected during the colorimetry of a patch image, this operation being triggered by a calibration execution start.

In step S301, the CAL continuation determination unit 107 determines whether or not an event that can decrease the accuracy of colorimetry has been detected. Where the CAL continuation determination unit 107 detects such an event (S301: YES), the processing advances to step S302. The CAL continuation determination unit 107 repeatedly performs the event detection with a predetermined period (S301: NO). In the present embodiment, where the UI control unit 106 detects that the main body button 108 has been pushed, the UI control unit 106 transmits a detection signal indicating that it is detected that the main body button 108 has been pushed to the CAL continuation determination unit 107. The CAL continuation determination unit 107 recognizes the occurrence of an event that can decrease the accuracy of colorimetry upon receiving the detection signal from the UI control unit 106.

In step S302, the CAL continuation determination unit 107 acquires a CAL state at the time of event occurrence in S301 from the CAL unit 104. The CAL state acquired in this case is either one of a state in which the CAL sensor 160 is performing the colorimetry of the patch images and a state in which the CAL sensor 160 is not performing the colorimetry of the patch images In step S303, the CAL continuation determination unit 107 determines whether or not the acquired CAL state is that in which the colorimetry is performed. Where the CAL state is that in which the colorimetry is performed (S303: YES), the processing advances to S304. Where the CAL state is that in which the colorimetry is not performed (S303: NO), the processing returns to S301. Where the CAL state is that in which the colorimetry is not performed, the calibration is continued.

In step S304, the CAL continuation determination unit 107 stops the calibration through the CAL unit 104 and hides the patch images that are presently displayed on the image display unit 103. The CAL continuation determination unit 107 also displays again, through the CAL unit 104, on the image display unit 103 the patch image that has been displayed immediately before the patch image displayed when the event that can decrease the accuracy of colorimetry has been detected in S301. For example, the patch image displayed when the event that can decrease the accuracy of colorimetry has been detected in S301 is taken as the patch image n (n-th image for colorimetry) (n is an integer of 2 or more). The patch image n is the very last image displayed when the event that can decrease the accuracy of colorimetry has been detected. The patch image displayed immediately before the patch image n is taken as a patch image n−1 ((n−1)-th image for colorimetry). The CAL continuation determination unit 107 performs, through the CAL unit 104, the colorimetry of the patch image (patch image n−1) which is to be displayed again on the image display unit 103 with the CAL sensor 160. In this case, the patch image n−1 is used as the patch image to be re-displayed, but a patch image other than the patch image n−1 may be also used as the patch image to be re-displayed, provided that it is the image (preceding image) displayed before the patch image displayed when the predetermined event has been detected.

In step S305, the CAL continuation determination unit 107 compares the colorimetry result of the patch image n−1 before the event detection and the colorimetry result of the patch image n−1 after the event detection, which have been acquired from the CAL unit 104. In the present embodiment, the brightness and chromaticity are compared as the colorimetry results. The brightness is an example of the colorimetry value, and chromaticity is also an example of the colorimetry value. The colorimetry values may use and be represented in any color representation system.

In step S306, the CAL continuation determination unit 107 determines whether or not the result obtained in comparing the colorimetry results is within a threshold. For example, when the difference (difference value) between the brightness of the patch images n−1 before and after the event detection is equal to or less than 10 cd/m$^2$, the CAL continuation determination unit 107 determines that the result is within the threshold, and where the difference is greater than 10 cd/m$^2$, it is determined that the result is not within the threshold. The threshold is not limited to 10 cd/m$^2$. The CAL continuation determination unit 107 may also determine that the result is within the threshold, for example, when the difference in distance in a color space between the chromaticity values of the patch images n−1 before and after the event detection is equal to or less than a predetermined threshold (equal to or less than a predetermined value), and where the difference is greater than the predetermined threshold, it may be determined that the result is not within the threshold.

Where the result is within the threshold (S306: YES), it is determined that the calibration can be continued, and the processing returns to step S301. The CAL unit 104 restarts the calibration from the patch image n. When the result is not within the threshold (S306: NO), it is determined that the accuracy of colorimetry has decreased and, therefore, the calibration cannot be continued, and the processing advances to step S307.

In step S307, the CAL unit 104 performs the processing of stopping the calibration according to the determination of the CAL continuation determination unit 107 that the calibration cannot be continued. In this case, the display 100 may notify the user by screen display or sound of the calibration stop.

Figure 4:
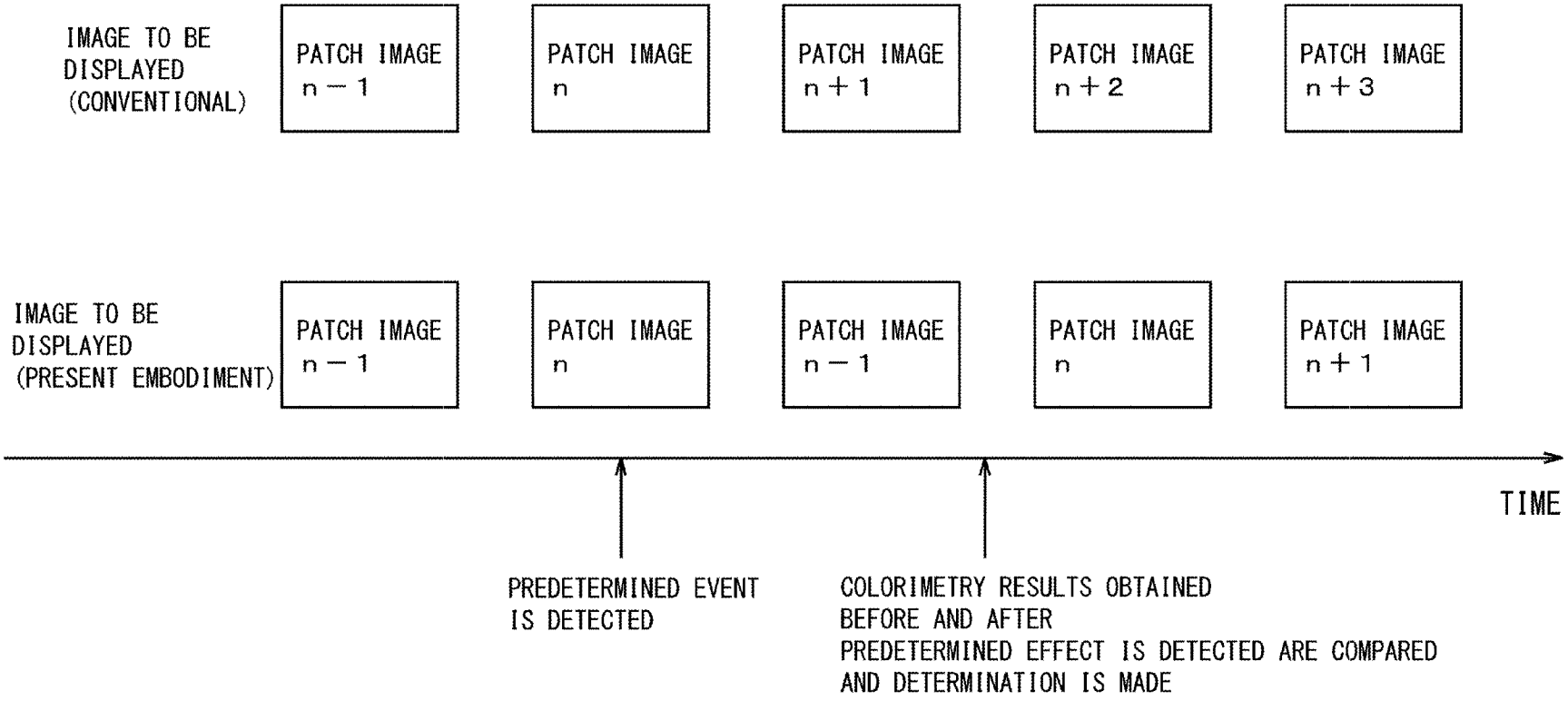
FIG. 4 is an example of patch drawing sequence according to Embodiment 1.

FIG. 4 illustrates the comparison of execution procedures of colorimetry and display of the patch images in calibration in the conventional example and the present embodiment in the case in which an event that can decrease the accuracy of colorimetry has been detected. In FIG. 4, the elapsed time is plotted against the abscissa. For example, as depicted in FIG. 4, the case is explained in which an event that can decrease the accuracy of colorimetry has occurred during the colorimetry of the n-th patch image (patch image n) as the calibration is executed. In the conventional procedure, the display performs the colorimetry and display of the next (n+1)-th patch image (patch image n+1) sequentially, regardless of the occurrence of the event that can decrease the accuracy of colorimetry. By contrast, in the present embodiment, the display 100 displays again the (n−1)-th patch image (patch image n−1) for which the colorimetry has been performed before the occurrence of the event and performs the colorimetry thereof. The CAL unit 104 transmits the colorimetry results obtained before the occurrence of the event and the colorimetry results obtained by performing the colorimetry again after the occurrence of the event to the CAL continuation determination unit 107. The CAL continuation determination unit 107 compares the colorimetry result obtained for the patch image before the occurrence of the event (patch image n−1) with the colorimetry result obtained from the patch image after the occurrence of the event (patch image n−1). In the example depicted in FIG. 4, it is determined that the calibration is to be continued, and the CAL unit 104 restarts the calibration from the patch image n.

Operation and Effect of Embodiment 1

In the present embodiment, when an event that can decrease the accuracy of colorimetry as the colorimetry of a patch image is executed is detected during the calibration of the display 100, the display 100 determines whether or not the calibration can be continued. Where the event that can decrease the accuracy of colorimetry is detected, the display 100 determines whether or not to stop the calibration processing by comparing the colorimetry results obtained before and after the event detection with the CAL sensor 160. When it is determined that the calibration cannot be continued, the display 100 stops the calibration. As a result, the calibration cannot be continued in a state in which the colorimetry accuracy, which is a factor causing the calibration to fail, has decreased, and the calibration implementation time, which is wasted when the calibration fails, can be reduced.

Embodiment 2

Embodiment 2 is explained below with reference to the drawings. Embodiment 2 and Embodiment 1 have some common features. Therefore, mainly the difference with Embodiment 1 is explained herein and the explanation of the features common with Embodiment 1 is omitted.

In Embodiment 1, when an event that can decrease the accuracy of colorimetry as the colorimetry of a patch image is executed is detected during the calibration, it is determined whether or not the calibration can be continued. In Embodiment 2, it is determined whether or not the calibration can be continued when an event that can decrease the accuracy of colorimetry is detected, regardless of whether or not the colorimetry of the patch image is executed, during the calibration.

Configuration Example

The block diagram of the principal configuration of the display according to Embodiment 2 is the same as that shown in FIG. 1 of the above-described Embodiment 1.

Operation Example

The operation of determining whether or not the calibration can be continued on the basis of an event that can decrease the accuracy of colorimetry is explained below.

Figure 5:
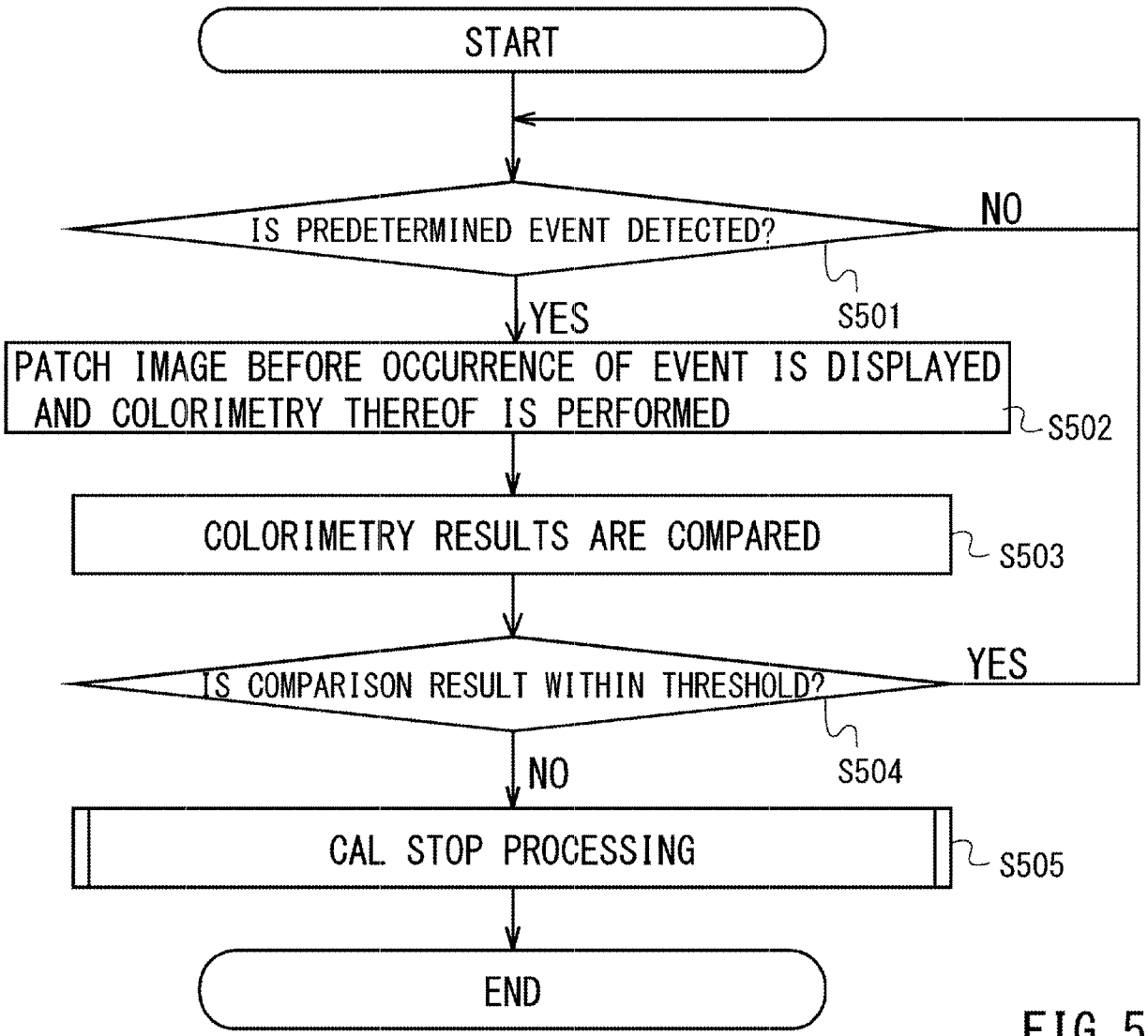
FIG. 5 is an example of operation flow relating to Embodiment 2.

FIG. 5 depicts the operation flow for determining whether or not the calibration can be continued when an event that can decrease the accuracy of colorimetry has been detected, this operation being triggered by a calibration execution start.

Step S501 is the same as step S301 of Embodiment 1.

In step S502, the CAL unit 104 interrupts the calibration. Then, the CAL continuation determination unit 107 redisplays on the image display unit 103 the second previously displayed image, as viewed from the point of time at which the event that can decrease the accuracy of colorimetry has been detected in step S501, through the CAL unit 104. Here, the first previously displayed patch image is the patch image n. As viewed from the point of time at which the event that can decrease the accuracy of colorimetry has been detected in step S501, the second previously displayed patch image is the patch image n−1. The CAL continuation determination unit 107 performs the colorimetry of the patch image (patch image n−1) displayed on the image display unit 103 with the CAL sensor 160 through the CAL unit 104.

Here, the second previously displayed patch image (patch image n−1) is used for redisplaying because of a time lag till the detection of the event that can decrease the accuracy of colorimetry and because it is possible that the event has occurred during the display of the patch image n. Where the event occurs during the display of the patch image n, the colorimetry result relating to the patch image n can be inaccurate. In other words, there is a difference between the time at which the patch image n−1 has been displayed and the time at which the event that can decrease the accuracy of colorimetry has been detected, and the display of the patch image n−1 can be assumed to be unaffected by the event that can decrease the accuracy of colorimetry.

Steps S503, S504, and S505 are the same as steps S305, S306, and S307, respectively, of Embodiment 1.

Figure 6:
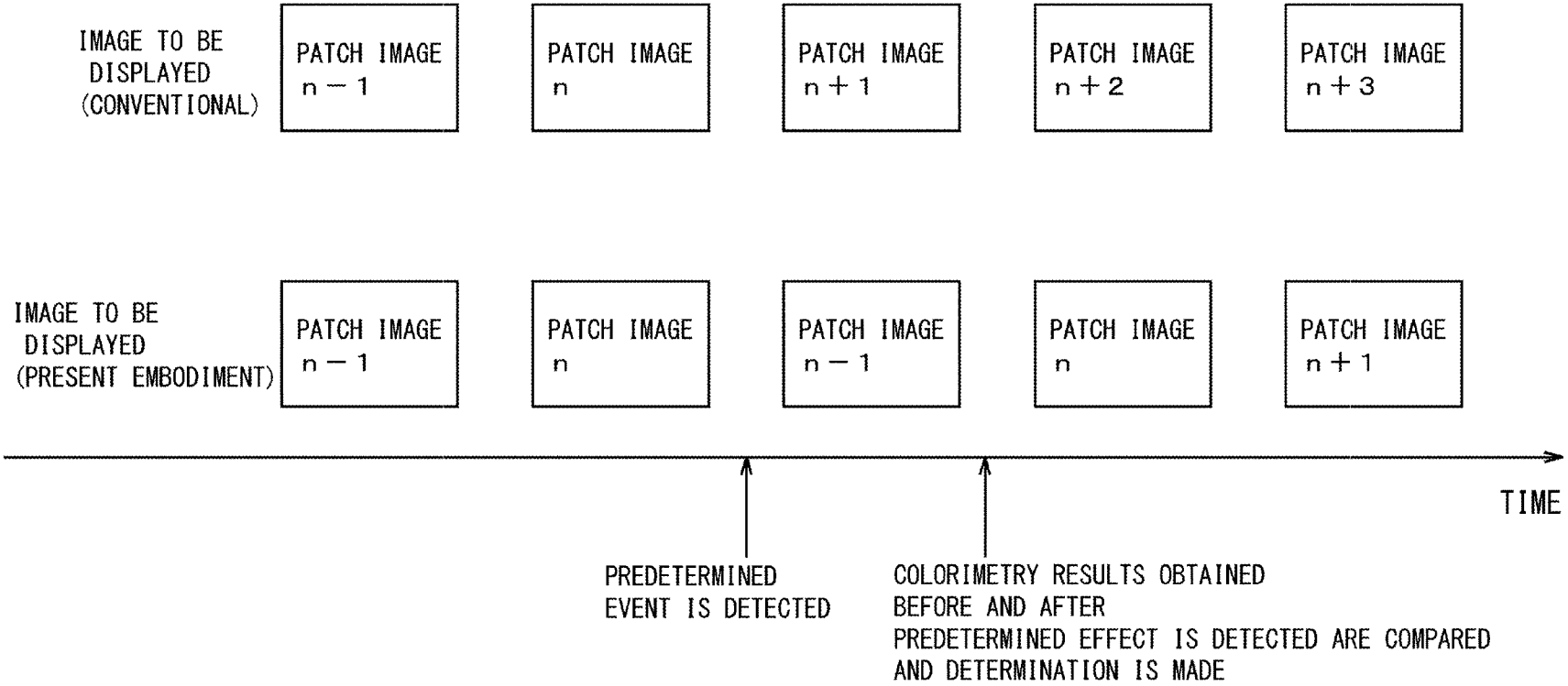
FIG. 6 is an example of patch drawing sequence according to Embodiments 2 to 4.

In FIG. 6 illustrates the comparison of execution procedures of colorimetry and display of the patch images in calibration in the conventional example and the present embodiment in the case in which an event that can decrease the accuracy of colorimetry is detected when the patch image is not displayed. In FIG. 6, the elapsed time is plotted against the abscissa. For example, as depicted in FIG. 6, when an event that can decrease the accuracy of colorimetry occurs after the colorimetry of the patch image n has been completed and the patch image n has been hidden and before the next patch image n+1 is displayed, the second preceding patch image n−1 for which an event is to be detected is redisplayed and the colorimetry thereof is performed. The CAL unit 104 transmits the colorimetry result obtained for the patch image n−1 before the occurrence of the event and the colorimetry result obtained for the patch image n−1 after the occurrence of the event to the CAL continuation determination unit 107. In the example depicted in FIG. 6, it is determined that the calibration is to be continued, and the CAL unit 104 restarts the calibration from the patch image n.

Operation and Effect of Embodiment 2

In the present embodiment, when an event that can decrease the accuracy of colorimetry is detected as the display calibration is executed, it is determined whether or not the calibration can be continued by using the second preceding patch image from the point of time at which the event has been detected. When it is determined that the calibration cannot be continued, the display stops the calibration. As a result, the calibration cannot be continued in a state in which the colorimetry accuracy, which is a factor causing the calibration to fail, has decreased, and the calibration implementation time, which is wasted when the calibration fails, can be reduced. Further, with the configuration of the present embodiment, the processing is simplified since it is not determined whether or not the colorimetry is performed. In addition, with the configuration of the present embodiment, since it is not determined whether or not the colorimetry is performed, determination is made on whether or not to continue the calibration even when the colorimetry is not performed.

Embodiment 3

Embodiment 3 is explained below with reference to the drawings. Embodiment 3 and Embodiments 1 and 2 have some common features. Therefore, mainly the difference with Embodiments 1 and 2 is explained herein and the explanation of the features common with Embodiments 1 and 2 is omitted.

In Embodiment 3, an example is explained in which a CAL sensor for calibration is incorporated in the display. The display identifies whether the CAL sensor that is used for colorimetry in the executed calibration is an incorporated CAL sensor or an external CAL sensor. The display detects an event that can decrease the accuracy of colorimetry and determines whether the calibration can be continued when the calibration is executed using the external CAL sensor.

In the present embodiment, the incorporated CAL sensor is firmly fixed to the display and represents a sensor (incorporated sensor) that cannot be displaced when an event that can decrease the accuracy of colorimetry occurs. For example, the incorporated CAL sensor is used for executing the calibration periodically and adjusting the image quality each time the drive time of the display exceeds a predetermined period of time. Meanwhile, the external CAL sensor is detachably attached to the display screen and is not fixed to the display. Therefore, this sensor can be displaced when an event that can decrease the accuracy of colorimetry occurs. The sensor that can be detachably attached to the display sensor is a sensor that can be attached to the display screen and detached therefrom.

Configuration Example

Figure 7:
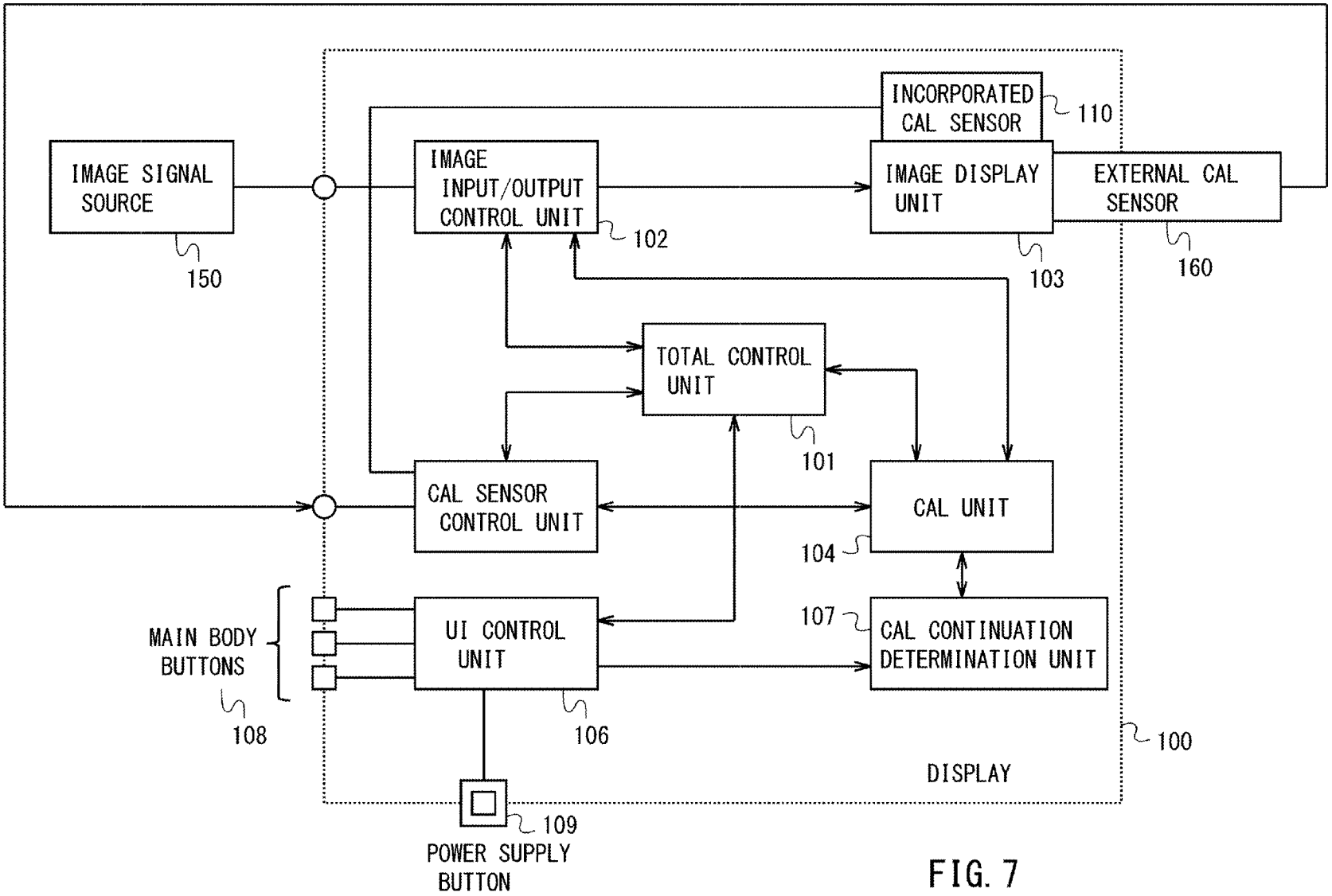
FIG. 7 is a block diagram illustrating the principal configuration of the display control device of Embodiment 3.

FIG. 7 is a block diagram illustrating the principal configuration of the display according to Embodiment 3. The difference between the block diagram depicted in FIG. 7 and the block diagrams of Embodiment 1 and Embodiment 2 illustrated by FIG. 1 is that an incorporated CAL sensor 110 is added to the configuration of the display 100. In this case, the CAL sensor 160 is taken as the external CAL sensor 160 in order to distinguish this sensor from the incorporated CAL sensor 110.

Operation Example

The operation of determining whether or not the calibration can be continued on the basis of an event that can decrease the accuracy of colorimetry is explained below.

Figure 8:
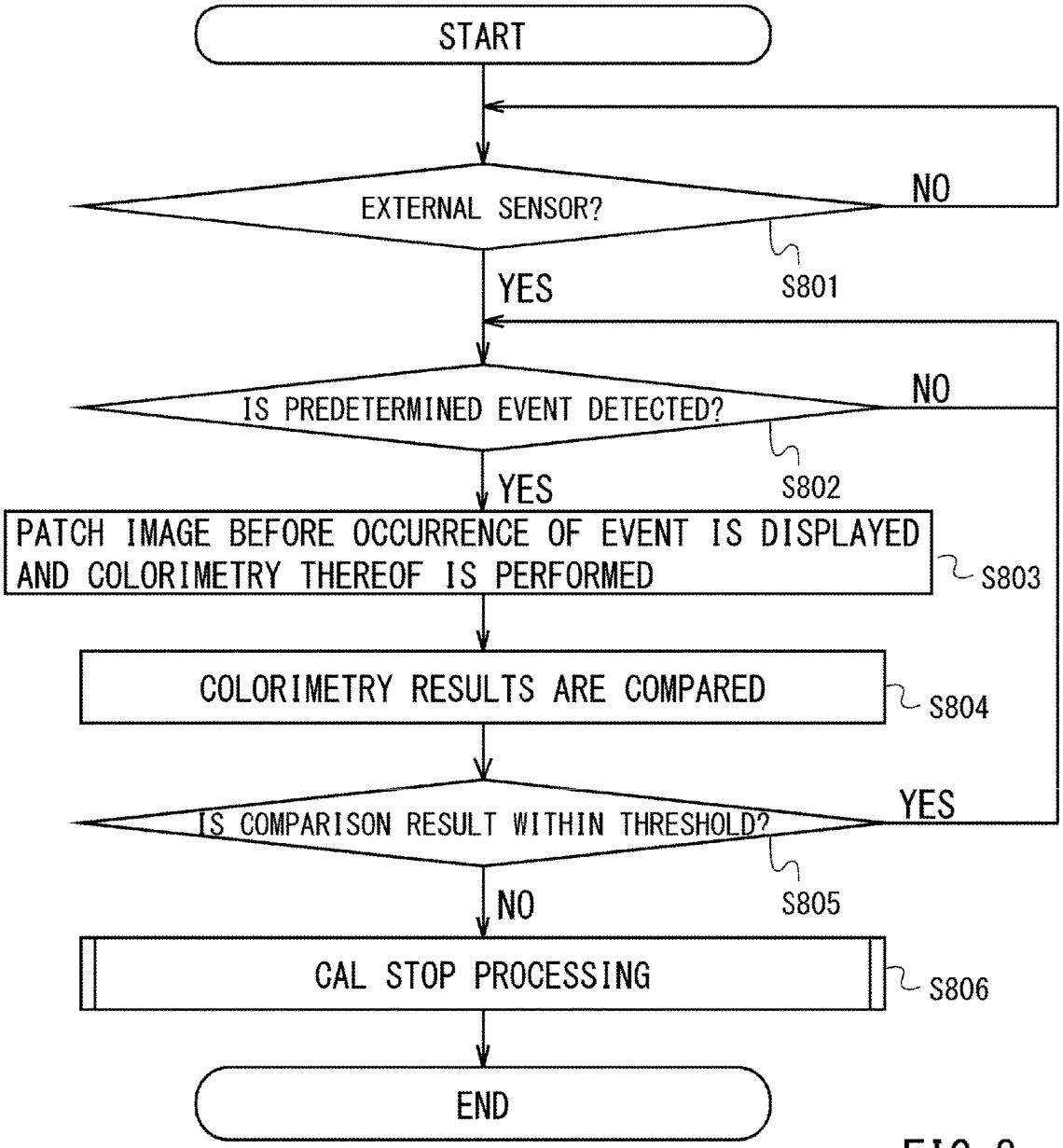
FIG. 8 is an example of operation flow relating to Embodiment 3.

FIG. 8 depicts the operation flow for detecting an event that can decrease the accuracy of colorimetry and determining whether or not the calibration can be continued in the case in which the colorimetry in calibration is performed using an external sensor, this operation being triggered by a calibration execution start.

In step S801, the CAL sensor control unit 105 identifies (determines) whether the CAL sensor used for colorimetry in the executed calibration is the incorporated CAL sensor 110 or the external CAL sensor 160. Where the external sensor is used (S801: YES), the processing advances to S802. Where the external CAL sensor 160 is not used (S801: NO), the processing returns to the flow start.

The processing of step S802 and subsequent steps is the same as the processing of step S501 and subsequent steps in Embodiment 2. The processing of step 802 and subsequent steps may be the same as the processing of step S301 and subsequent steps of Embodiment 1.

Operation and Effect of Embodiment 3

In the present embodiment, in a display incorporating a sensor for calibration, it is determined whether the incorporated CAL sensor 110 is used or the external CAL sensor 160 is used. Further, when the occurrence of an event that can decrease the accuracy of colorimetry is detected during the execution of calibration using the external CAL sensor 160, the display 100 determines whether or not to the calibration can be continued by using the second preceding patch image counted from the point of time at which the event has been detected. When it is determined that the calibration cannot be continued, the display 100 stops the calibration. As a result, the calibration cannot be continued in a state in which the colorimetry accuracy, which is a factor causing the calibration to fail, has decreased, and the calibration implementation time, which is wasted when the calibration fails, can be reduced.

The incorporated CAL sensor 160 is firmly fixed to the display 100, and the incorporated CAL sensor 110 is unlikely to be displaced when an event that can decrease the accuracy of colorimetry occurs. Therefore, when the calibration of the display 100 is executed using the incorporated CAL sensor 110, continuing calibration does not have to be stopped even when the occurrence of an event that can decrease the accuracy of colorimetry is detected. Thus, when the calibration of the display 100 is executed using the incorporated CAL sensor 110, determination does not have to be made on whether or not the calibration can be continued when the occurrence of an event that can decrease the accuracy of colorimetry is detected. As a result of not determining whether or not the calibration can be continued as the calibration is executed using the incorporated CAL sensor 110, it is possible to simplify the processing and prevent the calibration execution time from extending.

Embodiment 4

Embodiment 4 is explained below with reference to the drawings. Embodiment 4 and Embodiments 1 to 3 have some common features. Therefore, mainly the difference with Embodiments 1 to 3 is explained herein and the explanation of the features common with Embodiments 1 to 3 is omitted.

In the above-described Embodiments 1 to 3, the patch images are generated inside the display to perform the calibration. In Embodiment 4, the case is explained in which a personal computer (PC) generates patch images, and the generated patch images are outputted to the display to perform the calibration.

Configuration Example

Figure 9:
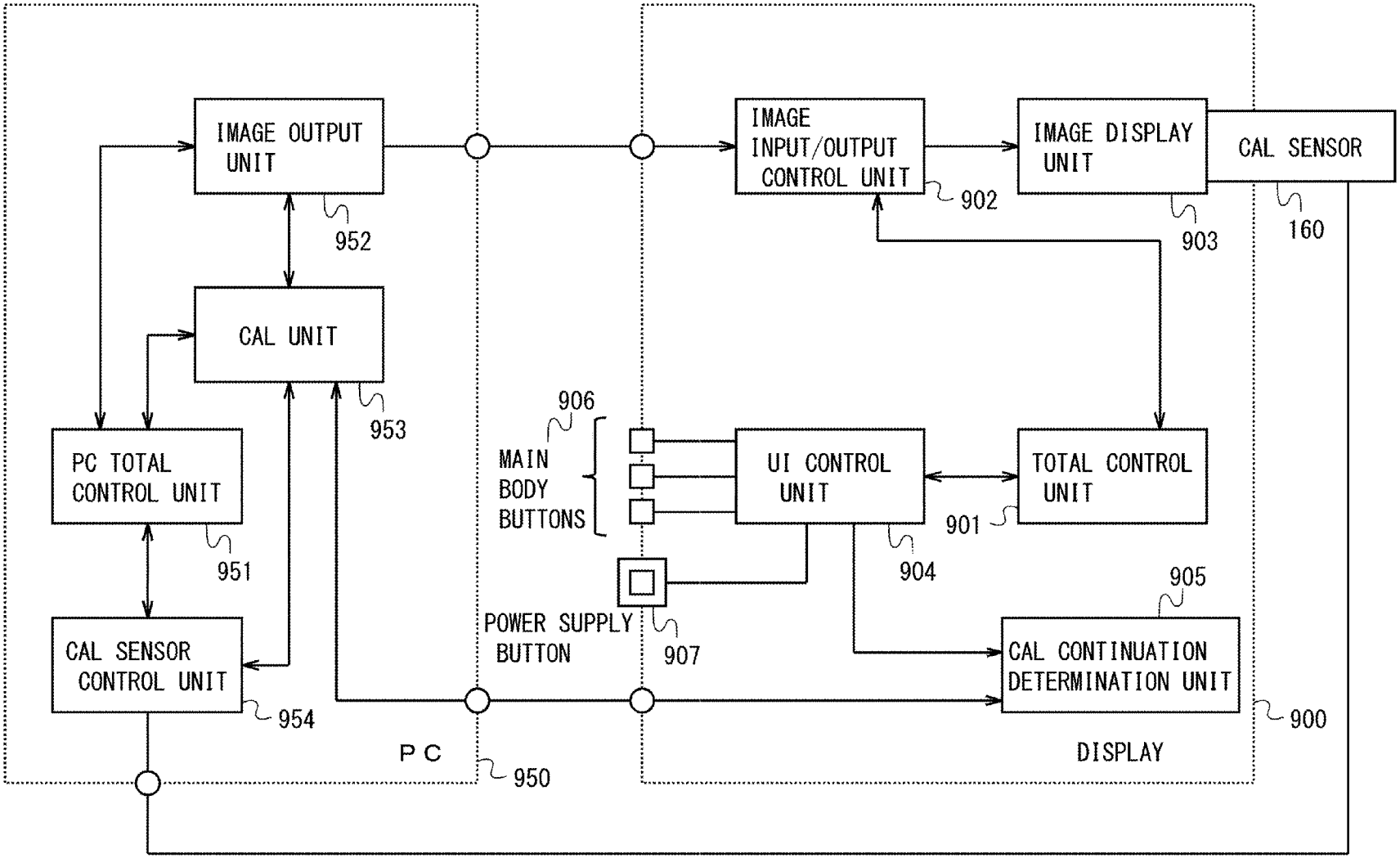
FIG. 9 is a block diagram illustrating the principal configuration of the personal computer and display control device according to Embodiment 4.

FIG. 9 is a block diagram illustrating the principal configuration of the display and PC in Embodiment 4.

A display 900 depicted in FIG. 9 has a total control unit 901, an image input/output control unit 902, an image display unit 903, a UI control unit 904, a CAL continuation determination unit 905, main body buttons 906, and a power supply button 907. A PC 950 depicted in FIG. 9 has a PC total control unit 951, an image output unit 952, a CAL unit 953, and a CAL sensor control unit 954.

In the present embodiment, for example, the display 900 and the PC 950 cooperatively form a display control device.

The total control unit 901, image input/output control unit 902, image display unit 903, UI control unit 904, CAL continuation determination unit 905, main body buttons 906, and power supply button 907 of the display 900 are configured similarly to the corresponding components of the display 100 of Embodiment 1. The CAL continuation determination unit 905 may be present in the PC 950.

The total control unit 951 of the PC 950 controls the entire PC 950.

The image output unit 952 outputs to the display 100 an image signal which is to be displayed on the display 100.

The CAL unit 953 controls the calibration of the display characteristic of the image display unit 903 of the display 900. The CAL unit 953 outputs an image signal of the patch image to be used in the calibration to the image output unit 952.

The CAL sensor control unit 954 controls the CAL sensor 160. The CAL sensor control unit 105 acquires a colorimetry value measured by the CAL sensor and outputs the acquired value to the CAL unit 953.

The user of the PC 950 implements the calibration by using the external CAL sensor 160 connected to the display 100.

Operation Example

The operation of determining whether or not the calibration can be continued on the basis of an event that can decrease the accuracy of colorimetry is explained below.

Figure 10:
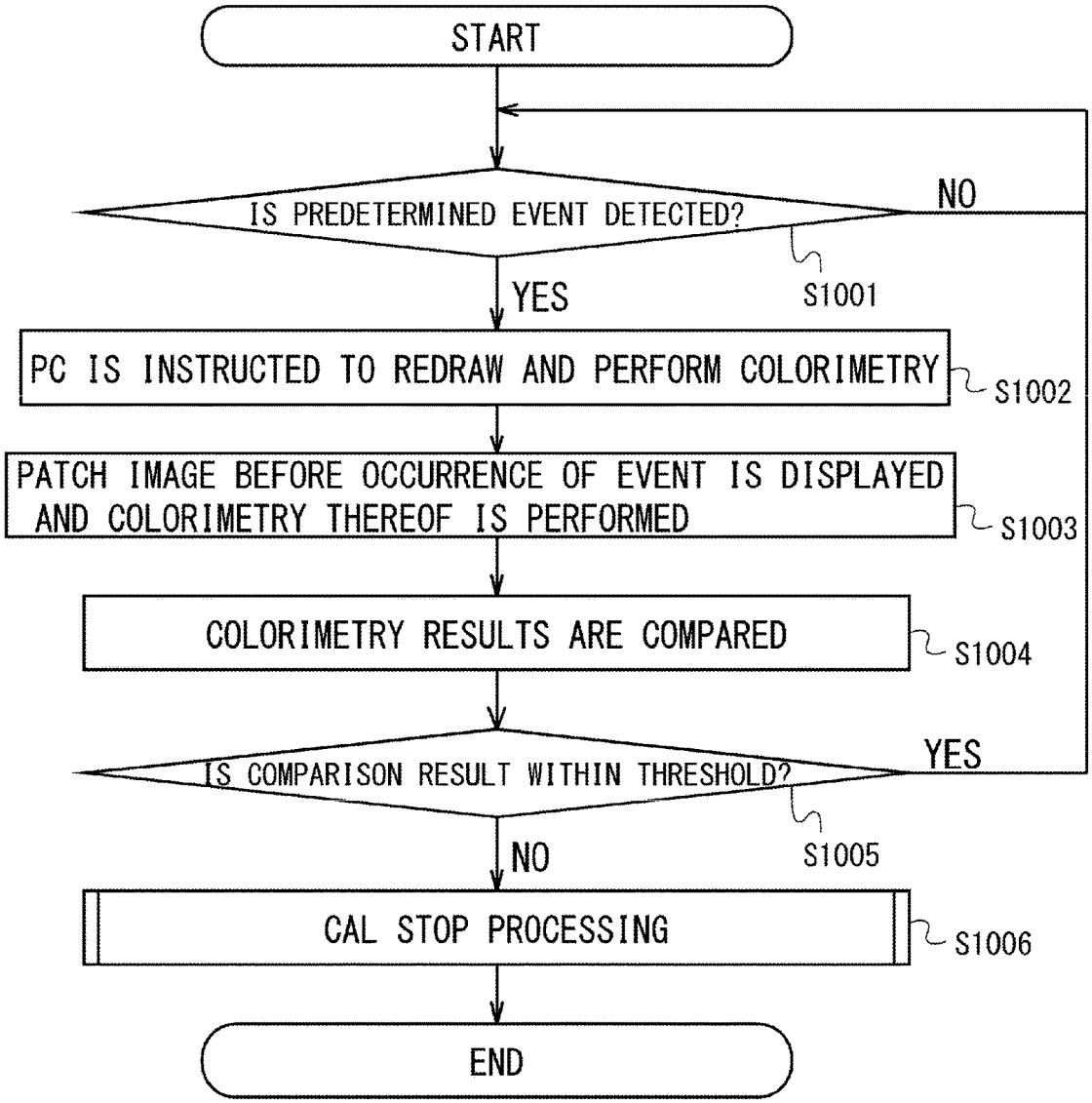
FIG. 10 is an example of operation flow relating to Embodiment 4.

FIG. 10 depicts the operation flow for determining whether or not the calibration can be continued in the case in which an event that can decrease the accuracy of colorimetry is detected during the calibration using the patch images outputted by the personal computer to the display.

In step S1001, the CAL continuation determination unit 905 determines whether or not an event that can decrease the accuracy of colorimetry has been detected. Where the CAL continuation determination unit 905 has detected the event (S1001: YES), the processing advances to step S1002. Where the CAL continuation determination unit 905 has not detected the event (S1001: NO), the processing returns to the flow start. In the present embodiment, the CAL continuation determination unit 905 detects an event that can decrease the accuracy of colorimetry by receiving from the UI control unit 904 a detection signal indicating that the main body button 906 has been pushed.

In step S1002, the CAL unit 953 interrupts the calibration. Then, the CAL continuation determination unit 905 redisplays on the image display unit 903 the second previously displayed image, as viewed from the point of time at which the event that can decrease the accuracy of colorimetry has been detected in step S1001, through the CAL unit 953. Here, the first previously displayed patch image is the patch image n. As viewed from the point of time at which the event that can decrease the accuracy of colorimetry has been detected in step S1001, the second previously displayed patch image is the patch image n−1. The CAL continuation determination unit 905 instructs the CAL unit 953 of the PC 950 to perform the colorimetry of the patch image (patch image n−1) displayed on the image display unit 903 with the CAL sensor 160.

In step S1003, the CAL unit 953 of the PC 950 instructs the image output unit 952 to display the patch image n+1 on the display 900. The image output unit 952 transmits the image signal of the patch image n−1 to the image input/output control unit 902 of the display 900. The image input/output control unit 902 outputs the patch image n−1 to the image display unit 103 in response to the display request of the image output unit 952. The CAL sensor control unit 954 issues a colorimetry request for the patch image n−1 to the CAL sensor 160, acquires the colorimetry result, and transmits the acquired colorimetry result to the CAL unit 953. The CAL unit 953 transmits the colorimetry result to the CAL continuation determination unit 905.

Steps S1004, S1005, and S1006 are the same as steps S305, S306, and S307, respectively, of Embodiment 1.

Operation and Effect of Embodiment 4

In the present embodiment, when an event that can decrease the accuracy of colorimetry is detected as the display calibration is executed using the patch images outputted by the PC, it is determined whether or not the calibration can be continued by using the second preceding patch image from the point of time at which the event has been detected. When it is determined that the calibration cannot be continued, the PC 950 stops the calibration. As a result, the calibration cannot be continued in a state in which the colorimetry accuracy, which is a factor causing the calibration to fail, has decreased, and the calibration implementation time, which is wasted when the calibration fails, can be reduced.

Other Embodiments

An example in which an acceleration sensor is installed on a display in order to detect an event that can decrease the accuracy of colorimetry is described below. In this case, the display has the acceleration sensor that measures a force applied to the display. The acceleration sensor detects the acceleration of the display. For example, an event that can decrease the accuracy of colorimetry is detected on the basis of information acquired from the acceleration sensor when the display body moves, and the processing of determining whether or not the calibration can be continued is performed. Thus, where the acceleration detected by the acceleration sensor exceeds a predetermined value, the display determines that an event that can decrease the accuracy of colorimetry has occurred. The acceleration sensor installed on the display detects the acceleration of the display. When the acceleration of the display changes, the position of the display body (display device body) changes.

The operation of a touch panel display (also can be referred to simply as "touch panel") is considered below as an event that can decrease the accuracy of colorimetry. The touch panel display has a touch sensor disposed on the surface of a display panel. For example, the touch panel display detects that the touch sensor has been operated (touch operation) and performs the processing of determining, on the basis of this event, whether or not the calibration can be continued. Thus, when the touch sensor is operated, the display determines that an event that can decrease the accuracy of colorimetry has occurred. The touch sensor detects a touch by the user's finger or the like. The detection of the operation by the touch sensor includes the detection of a touch of the touch sensor by the user's finger or the like.

The case in which a cable such as a signal (DVI, DP, or the like) cable of a display or a power supply cable is connected or disconnected is considered below as an event that can decrease the accuracy of colorimetry. In this case, the display additionally has unit configured to detect the connection and disconnection of the cable. For example, where the display detects that the DP cable has been connected or disconnected, the processing of determining whether or not the calibration can be continued is performed. Thus, when it is detected that the DP cable has been connected or disconnected, the display determines that an event that can decrease the accuracy of colorimetry has occurred.

The display determines that an event that can decrease the accuracy of colorimetry has occurred by detecting the acceleration of the display which is greater than the predetermined value, the touch panel operation of the display, and connection/disconnection of the cable to/from the display. Since those events cause the physical movement of the display, the positional relation between the display panel and the CAL sensor may change and the accuracy of colorimetry may decrease. By determining whether or not to continue the calibration (calibration processing) when the occurrence of such events has been detected, the display can reduce the wasted calibration implementation time.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The above-described embodiments can be implemented, whenever possible, in combinations thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-10182, filed on Jan. 23, 2014, which is hereby incorporated by reference herein in its entirety.

What is claimed is:

1. A display control device comprising:

a calibration unit configured to display a plurality of images for colorimetry on a screen in a sequential order and to perform calibration processing of adjusting display quality on the basis of a colorimetry result obtained by colorimetry with a sensor;

a detection unit configured to detect a predetermined event that can decrease an accuracy of colorimetry of the sensor while the calibration processing is executed; and a determination unit configured to perform determination processing of determining whether or not to stop the calibration processing by comparing the colorimetry results before and after the detection of the predetermined event with the sensor in a case where the detection unit detected the predetermined event, wherein the determination unit displays again on the screen a preceding image for colorimetry that had been displayed before the predetermined event was detected by the detection unit, performs colorimetry with the sensor, and determines to stop the calibration processing in a case where a difference between a colorimetry value of the preceding image before the predetermined event as detected by the detection unit and a colorimetry value of the preceding image after the predetermined event was detected by the detection unit is greater than a predetermined value.

2. The display control device according to claim 1, wherein in the calibration processing, a plurality of images for colorimetry is successively displayed one by one and colorimetry thereof is performed;

when the detection unit has detected the predetermined event, the determination unit displays again on the screen a preceding image that has been displayed before an n-th image for colorimetry, which is the n-th (n is an integer of 2 or more) image for colorimetry that has been the last displayed image from among the plurality of images for colorimetry, when the detection unit has detected the predetermined event, performs colorimetry with the sensor, and determines to stop the calibration processing when a difference value which is a difference between a colorimetry value of the preceding image before the predetermined event is detected by the detection unit and a colorimetry value of the preceding image after the predetermined event has been detected by the detection unit is greater than a predetermined value.

3. The display control device according to claim 2, wherein when the difference value is equal to or less than the predetermined value, the calibration unit restarts the calibration processing from the n-th image for calibration.

4. The display control device according to claim 2, wherein the preceding image is an (n−1)-th image for calibration that has been displayed immediately before the n-th image for calibration.

5. The display control device according to claim 2, wherein the determination unit determines whether or not the sensor performs the colorimetry, and performs the determination processing only when the predetermined event has been detected by the detection unit while the colorimetry is performed by the sensor.

6. The display control device according to claim 1, wherein the predetermined event is a button operation performed to an operation button of a display device having the screen.

7. The display control device according to claim 1, wherein the screen is a screen of a touch panel type having a touch sensor; and the predetermined event is an operation of touching the touch sensor.

8. The display control device according to claim 1, wherein the predetermined event is connection/disconnection of a cable to/from a display device body having the screen.

9. The display control device according to claim 1, wherein the predetermined event is a change in a position of a display device body having the screen.

10. A display control device comprising:

a calibration unit configured to display an image for colorimetry on a screen and to perform calibration processing of adjusting display quality on the basis of a colorimetry result obtained by colorimetry with a sensor;

a detection unit configured to detect a predetermined event that can decrease an accuracy of colorimetry of the sensor while the calibration processing is executed;

a determination unit configured to perform determination processing of determining then or not to stop the calibration processing by comparing the colorimetry results before and after the detection of the predetermined event with the sensor in a case where the detection unit detected the predetermined event;

a sensor control unit configured to determine whether or not the sensor is an internal sensor incorporated in a display device body having the screen, or an external sensor which can be attached to and detached from the display device, wherein the determination unit performs the determination processing only when the sensor control unit determines that the sensor is the external sensor.

11. A control method for a display control device, the method comprising:

displaying a plurality of images for colorimetry on a screen in a sequential order and performing calibration processing of adjusting display quality on the basis of a colorimetry result obtained by colorimetry with a sensor;

detecting a predetermined event that can decrease an accuracy of colorimetry of the sensor while the calibration processing is executed; and performing determination processing of determining whether or not to stop the calibration processing by comparing the colorimetry results before and after the detection of the predetermined event with the sensor in a case where the predetermined event was detected, wherein a preceding image that had been displayed before the predetermined event was detected, is displayed again on the screen, and colorimetry of the displayed preceding image is performed with the sensor; and determination is made to stop the calibration processing in a case where a difference between a colorimetry value of the preceding image before the predetermined event was detected and a colorimetry value of the preceding image after the predetermined event was detected is greater than a predetermined value.

12. The control method for a display control device according to claim 11, wherein in the calibration processing, a plurality of images for colorimetry is successively displayed one by one and colorimetry thereof is performed;

in the determination processing, a preceding image that has been displayed before an n-th image for colorimetry, which is the n-th (n is an integer of 2 or more) image for colorimetry that has been the last displayed image from among the plurality of images for colorimetry, is displayed again on the screen when the predetermined event has been detected, and colorimetry of the displayed preceding image is performed with the sensor; and determination is made to stop the calibration processing when a difference value which is a difference between a colorimetry value of the preceding image before the predetermined event is detected and a colorimetry value of the preceding image after the predetermined event has been detected is greater than a predetermined value.

13. The control method for a display control device according to claim 12, wherein when the difference value is equal to or less than the predetermined value, the calibration processing is restarted from the n-th image for calibration.

14. The control method for a display control device according to claim 12, wherein the preceding image is an (n−1)-th image for calibration that has been displayed immediately before the n-th image for calibration.

15. The control method for a display control device according to claim 12, further comprising determining whether or not the sensor performs the colorimetry, wherein the determination processing is performed only when the predetermined event has been detected while the colorimetry is performed by the sensor.

16. The control method for a display control device according to claim 11, wherein the predetermined event is a button operation performed to an operation button of a display device having the screen.

17. The control method for a display control device according to claim 11, wherein the screen is a screen of a touch panel type having a touch sensor; and the predetermined event is an operation of touching the touch sensor.

18. The control method for a display control device according to claim 11, wherein the predetermined event is a change in a position of a display device body having the screen.

19. The display control method according to claim 11, wherein the predetermined event is connection/disconnection of a cable to/from a display device body having the screen.

20. A control method for a display control device, the method comprising:

displaying a plurality of images for colorimetry on a screen in a sequential order and performing calibration processing of adjusting display quality on the basis of a colorimetry result obtained by colorimetry with a sensor;

detecting a predetermined event that can decrease an accuracy of colorimetry of the sensor while the calibration processing is executed; and performing determination processing of determining whether or not to stop the calibration processing by comparing the colorimetry results before and after the detection of the predetermined event with the sensor in a case where the predetermined event was detected;

determining whether or not the sensor is an internal sensor incorporated in a display device body having the screen, or an external sensor which can be attached to and detached from the display device, wherein the determination processing is performed only when determination is made that the sensor is the external sensor.

* * * * *